US005471923A

United States Patent [19]

Carroll et al.

[11] Patent Number: 5,471,923

[45] Date of Patent: Dec. 5, 1995

[54] MULTIPLE STAMPING DIES WITH CUMULATIVE STAMPING MARKERS AND METHOD OF STAMPINGS PARTS

[75] Inventors: James E. Carroll, St. Clair Shores; Ronald L. Lambert, Hale, both of Mich.

[73] Assignee: Chrysler Corporation, Highland Park, Mich.

[21] Appl. No.: 358,508

[22] Filed: Dec. 19, 1994

[51] Int. Cl.[6] ..... B31F 1/07

[52] U.S. Cl. ..... 101/32; 101/485; 101/44; 101/28; 72/7; 72/362

[58] Field of Search ..... 101/483, 484, 101/486, 211, 32, 44, 27, 28, 31, 4; 72/6, 7, 352, 356, 362

[56] References Cited

U.S. PATENT DOCUMENTS

| | | | |
|---|---|---|---|
| 2,165,286 | 7/1939 | Mattlage | 101/32 |
| 3,015,266 | 1/1962 | Anderson et al. . | |
| 3,218,969 | 11/1965 | Nagel . | |
| 3,851,517 | 12/1974 | Greenleaf | 72/352 |
| 4,116,361 | 9/1978 | Stargezl | 220/273 |
| 4,198,906 | 4/1980 | Fujikawa et al. | 101/42 |
| 4,546,700 | 10/1985 | Kishner et al. | 101/211 |
| 4,632,667 | 12/1986 | McDonald et al. | 493/187 |
| 4,679,071 | 7/1987 | Kitagawa | 358/75 |
| 4,712,473 | 12/1987 | Amos | 101/4 |
| 4,732,082 | 3/1988 | Ireton | 101/32 |
| 4,890,715 | 1/1990 | Sticht | 198/340 |
| 5,056,430 | 10/1991 | Bayerlein et al. | 101/211 |
| 5,081,923 | 1/1992 | LaMantia et al. | 101/32 |
| 5,201,589 | 4/1993 | Chun et al. | 400/134 |
| 5,212,647 | 5/1993 | Raney et al. | 364/474.34 |
| 5,216,234 | 6/1993 | Bell | 235/494 |
| 5,247,825 | 9/1993 | Erickson | 72/339 |
| 5,311,759 | 5/1994 | Mangrulkar et al. | 72/12 |

*Primary Examiner*—Eugene H. Eickholt
*Attorney, Agent, or Firm*—Edward A. Craig

[57] ABSTRACT

Stamping dies and method for stamping parts using multiple stamping stations with different bottom markers in successive dies that mark the part being produced at selected stations with different markings related to one another, which cumulatively provide an observable completed set of marks on a part such as one finally stamped to readily show whether or not the stamping has been properly executed and to identify any stamping station or stations that is not stamping to specification.

10 Claims, 3 Drawing Sheets

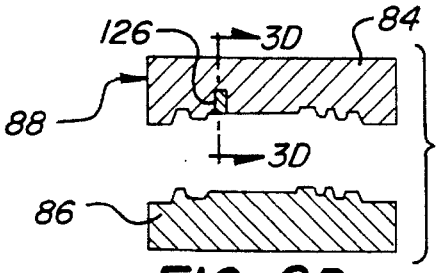
FIG-2D
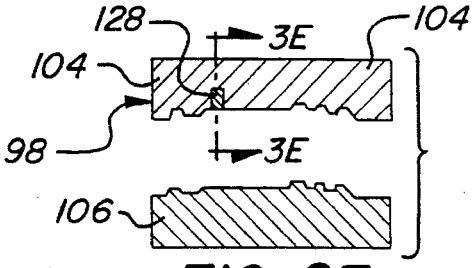
FIG-2E
FIG-3D
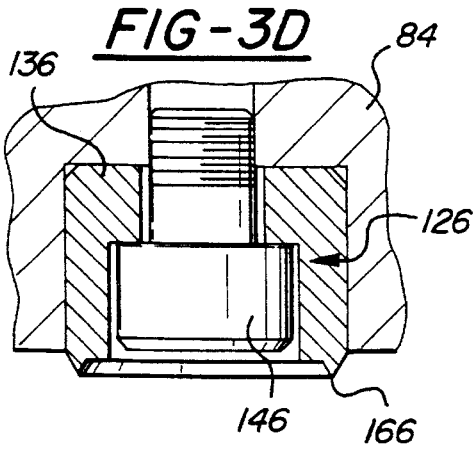
FIG-3E
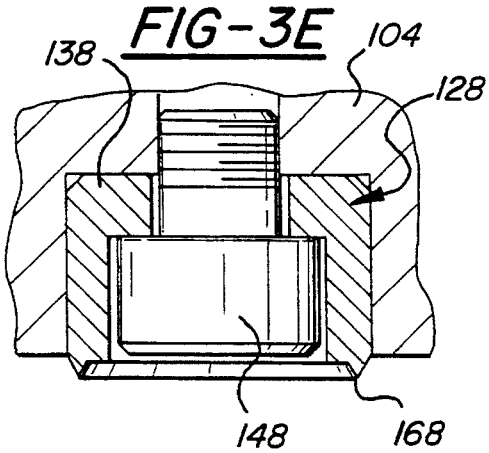
FIG-4D
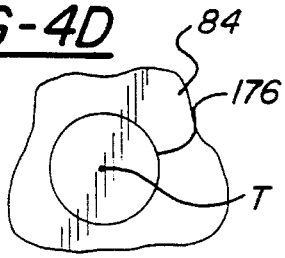
FIG-4E
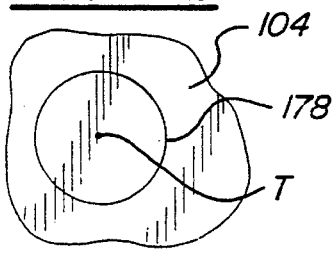
FIG-5D
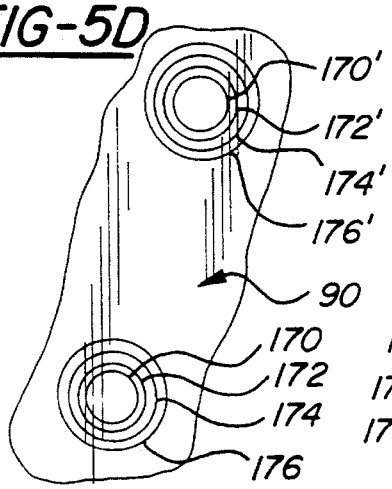
FIG-5E
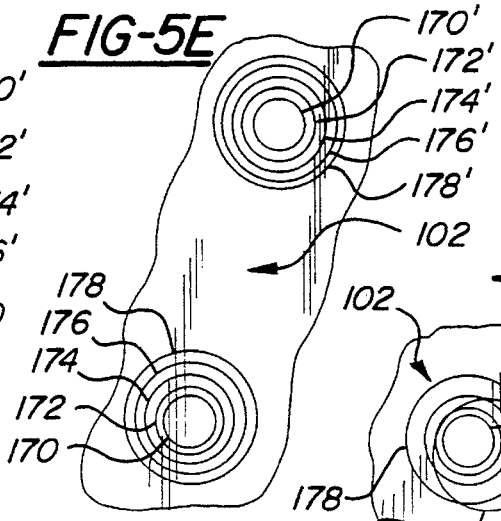
FIG-6
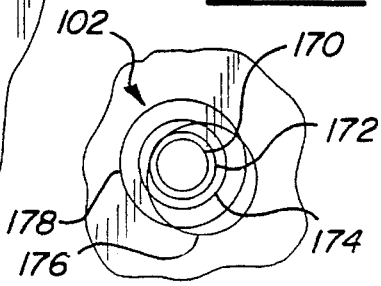

MULTIPLE STAMPING DIES WITH CUMULATIVE STAMPING MARKERS AND METHOD OF STAMPINGS PARTS

This invention relates to mechanism and method for stamping parts with a series of stamping dies and, more particularly, to new and improved stamping die sets with bottoming markers that marks parts stamped in a multiple station stamping line with observable cumulative marks that interrelate to show whether or not the parts are being properly stamped and indicate any station not stamping to specifications.

BACKGROUND OF THE INVENTION

Prior to the present invention, stamping dies sets have been provided with pins and other guide devices to insure that the dies making the parts are in accurate alignment, and with gaging blocks to insure that the blank or part being stamped is properly located in the die set so the stamped part meets specifications. While prior constructions and gaging procedures provide for quality stampings, the prior pins, gaging blocks and other devices for ensuring accuracy in stamped parts, particularly those produced with multiple die sets, may become worn or damaged to such an extent that the stamped parts produced by such die sets fail to meet specifications so that they have to be reworked or scraped.

With such problems being encountered with increasing frequency and with the demand and requirement for more precisely produced parts, the present invention addresses and solves a wide range of out of spec stampings by the provision of new and improved statistical process control tooling preferably in the form of cooperative bottoming markers in the die sets of multiple station dies to insure the dies that are making the parts are in the home position and that the part meets stamping specifications.

In one preferred form and embodiment of the invention, a different marker is placed in a predetermined location in each die set so that at the end of the stamping operation in which a part is made, marks made on the stamped part relate to one another to define a configuration to visually inform an inspector whether or not the part meets specifications. Importantly, if the part does not fall within specifications, the press line operator or other inspector is able to immediately note that the part produced is out of specification and be advised by the mark which die sets need to be adjusted or repaired so that parts can be subsequently stamped with the required accuracy for acceptance.

Importantly, the preferred embodiment of the invention employs sets or series of bottoming markers that visibly mark, coin or otherwise produce visible patterns such as concentric circles in the part as it is being progressively formed along a multi-station stamping line to indicate acceptability of the stamped part.

Different diameter markers are placed in corresponding locations in each of the dies sets so that at the end of stamping circular marks formed on the part by the markers usually center together around a common point and form a "bulls eye" to indicate that the stamped part is made to specifications. In the event a part gets off location in any one or more of the die sets, the circles would become noticeably eccentric with respect to the planned center and may overlap. Since the different circles readily reveal which die set causes any overlap or substantial eccentricity, that die set can be adjusted or repaired as needed to correct die problems.

While circles are featured as the observable preferred markings, other geometric configurations, such as rectangles, triangles and line markings, or combinations thereof, or other shapes can now be readily used in place of circles to readily indicate die set accuracy or inaccuracy. Furthermore, while this invention has been generated to improve accuracy in the staged stamping of metal parts, plastics and composite materials may also be stamped or otherwise marked with the bottom marker tools and methods of this invention.

Another feature, object and advantage of this invention is to provide new and improved die structures and stamping methods involving the application of juxtaposition markings on parts being stamped in various stamping stations that accumulate and visually indicate whether of not a part being stamped is within specification and, if not, which of the stations is causing inaccuracy in the stamping so that such stations can be readily repaired.

These and other features, object and advantages of the invention will become readily apparent from the following detail description and drawing in which:

DESCRIPTION OF THE DRAWINGS

FIGS. 2*a* through 2*e*, respectively, are diagrammatic cross-sectional views of stamping dies taken respectively along sight lines 2*a*—2*a* through 2*e*—2*e* of FIG. 1;

FIGS. 3*a* through 3*e*, respectively, are views partially in cross-section taken generally along sight lines 3*a* through 3*e* of FIGS. 2*a* through 2*e* respectively;

FIGS. 4*a*–4*e* are top views of marks stamped by the marking dies of FIGS. 3*a*–3*e*, respectively;

FIGS. 5*a*–5*e* are diagrammatic top views of pairs of markings progressively made by the markings die sets of the die stations of FIG. 1; and FIG. 6 is a top view of cumulative markings made on a stamped part by bottom markers of the dies of the stations of FIG. 1 showing a stamping which does not meet specifications.

DETAILED DESCRIPTION OF THE DRAWINGS

Figure 1:
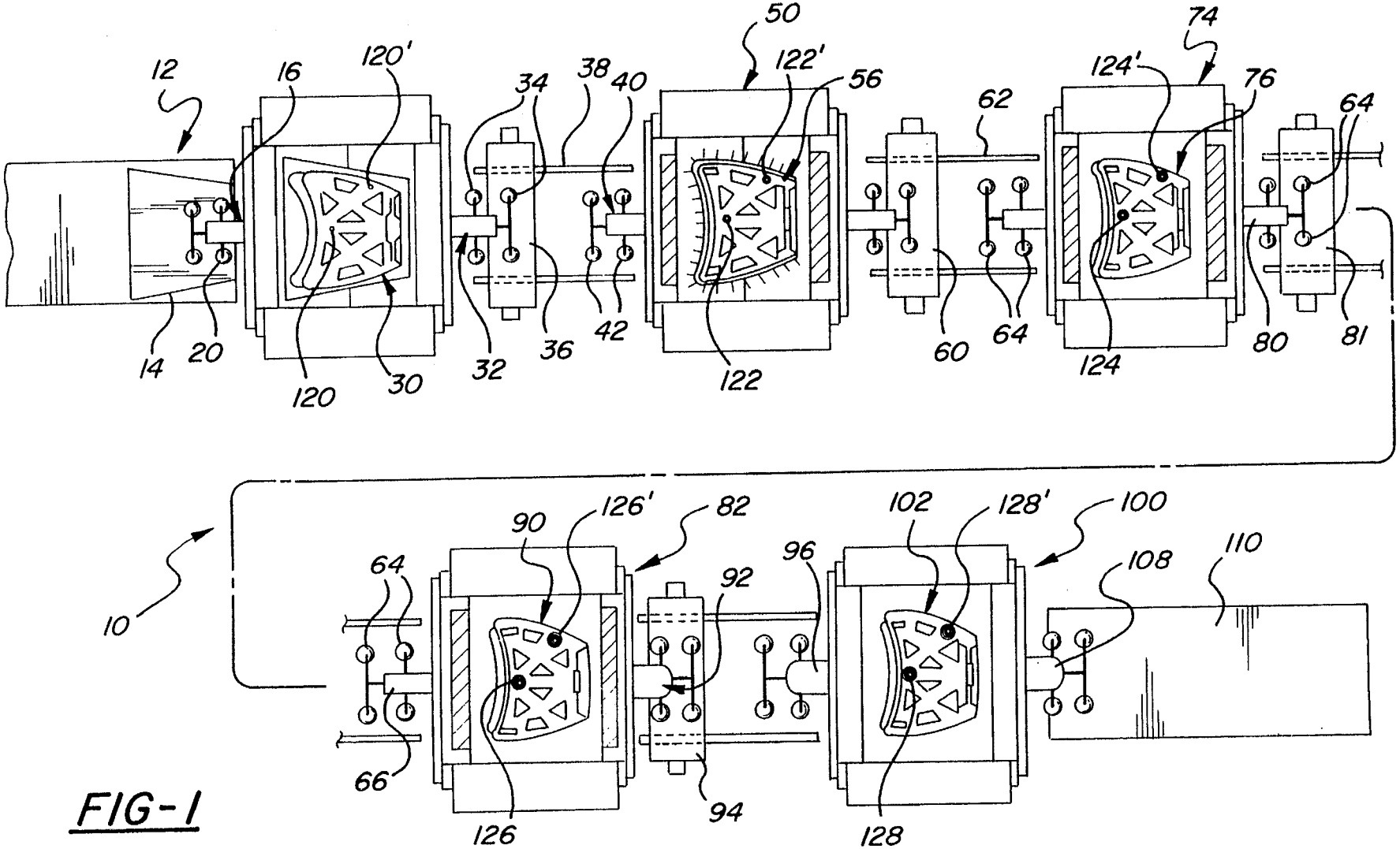
FIG. 1 is a diagrammatic top view of a stamping line having multiple stamping stations.

Turning now in greater detail to the drawing, there is diagrammatically shown in FIG. 1 a multi-station stamping line 10 including a loading station 12 supporting a supply of sheet metal blanks 14 which can be serially moved by a retractable loader 16 with suction cups 20 into a first stamping die set 22 of a first stamping station 24 of the line 10.

Figure 2A:
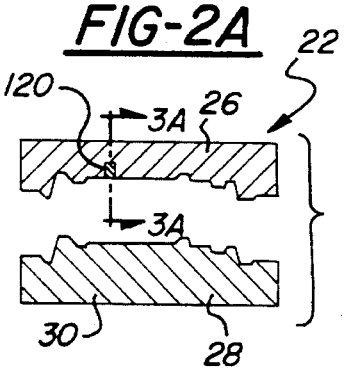
Figure 2B:
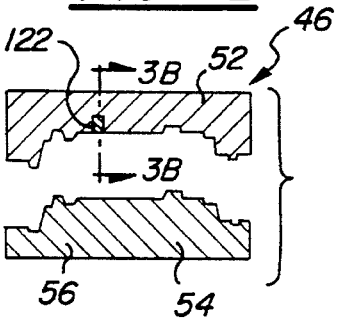

The first stamping die set has upper and lower dies 26, 28 diagrammatically shown in cross section in FIG. 2*a*. The first die set 22, as well as the others of the stamping line, are operated by conventional presses and rams which move the dies between open and closed positions such as disclosed in U.S. Pat. No. 3,851,517 entitled "Process for Manufacturing curved Channel Members" issue Dec. 3, 1974 to J .P Greenleaf which is hereby incorporated by reference.

The upper and lower dies 26, 28 of die set 22 are configured to stamp the sheet metal blanks 14 into a first form 30 in a first stage stamping operation. After the initial stamping in which the blank is formed and trimmed into the first form, the dies are opened and the first form 30 is transferred from the first die set of station 24 by an unloader 32 having suction cups 34 which are operated to hold the first form 30 by vacuum while the unloader arm moves the first form onto a transfer carriage 36 movable along rail way 38 to an end position at which loading mechanism 40 with suction cups 42 is operated to load the first form into a second die set 46 at a second stamping station 50.

The second die set 46 has upper and lower dies 52, 54 operatively mounted in a conventional press of the stamping press line 10. After the first form has been restruck by operation of die set 46 into a second stamped form 56, the second form is moved by an unloader 58, which is like the first station unloader 32, from the die set 50 onto the transfer carriage 60. This carriage moves along rails 62 to a loading station at which the suction cups 64 of loader 66 are engaged at locations on the second stamped form 56 so that they can be evacuated of air and the part 56 can be retained by atmospheric pressure.

Figure 2C:
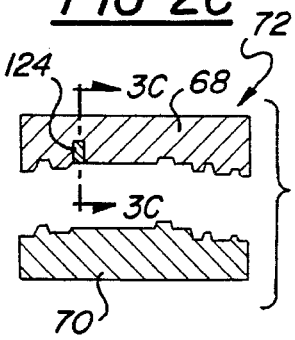
Figure 3A:
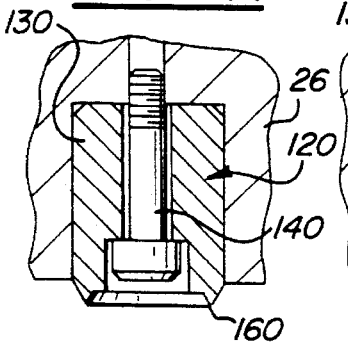
Figure 3B:
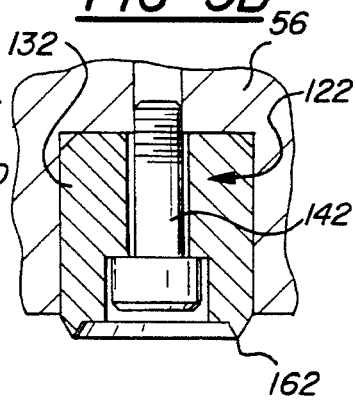
Figure 3C:
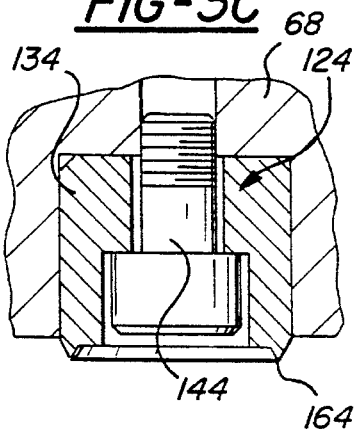

The loader 66 then retracts and moves the second form 56 into the open dies 68, 70 of the third die set 72 of the third stamping station 74. After being seated therein the vacuum of the cups is broken and the loader is retracted from the dies such as in any conventional loading and unloading apparatus and practice. As in previous stamping operations, the dies of die set 72 are then closed, as diagrammatically illustrated in FIG. 2*c*, by the associated press in the press line 10. This action stamps the part into its third configuration or form 70. The restruck or trimmed third form 76 is then removed from the third die set of the third stamping station 74 by the unloader 80.

In a manner as above described, the restamped part 76 is moved by carriage 81 to the fourth station 82 and into the open dies 84 and 86 of forth station die set 88. After being struck by the fourth die set, the restruck part 90 is similarly handled and moved by unloader 92, carriage 94 and loader 96 into the fifth die set 98 of the fifth station 100 where the part 90 is restruck into its final form shown as part 102 by upper and lower dies 104, 106 of the die set 98. Subsequently, the finally restruck part 102 is transferred by unloader 108 to the conveyor 110 which moves the stamped and finished part 102 to a shipping or an assembly point P shown in FIG. 1.

In view of the wide size variations found in parts stamped in prior stamping press lines, and with increasing demand for closer held tolerances in stamped parts, this invention provides pairs of matched sets of bottom markers, one of the matched sets is shown in detail and comprises markers 120, 122, 124, 126 and 128. The markers of each set of bottom markers are serially employed with the die sets 22, 46, 72, 88, and 98, or any selected number thereof, to provide the mechanism to ensure that the parts are made to higher standards and closer tolerances and to quickly and accurately identify any stamping station or stations that are not stamping parts to specification.

The marking dies 120, 122, 124, 126, 128 of a first set, respectively, have cylindrical bodies 130, 132, 134, 136 and 138 that progressively increase in diameter and each has and each has an axial passage therethrough progressively sized in diameter to receive corresponding threaded fasteners 140, 142, 144, 148 and 150 having increasing diameters that secure the marker dies in matching bore found in the upper dies of each of the die sets. Since the bores are carefully sized to receive the respective marker dies, only an appropriate marker die will closely fit into its corresponding bore. Also, since the threaded fasteners 140, 142, 144, 146 and 148 only fit within accommodating axial openings in the associated marker dies and the tapped openings in the upper dies, the chance of inadvertent installation of a marker die in an inappropriate bore is substantially eliminated. By this arrangement, each marker die is associated with a particular die set and stamping station so that each stamping station can be readily identified by its particular marking die.

Figure 4A:
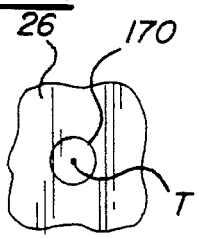
Figure 4B:
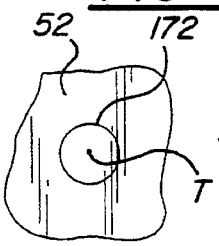
Figure 4C:
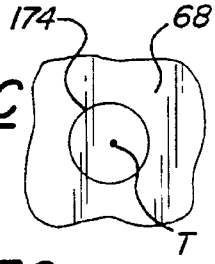

The bottoming markers have faces with raised circular markers 160, 162, 164, 166 and 168 to impress permanent circular indentations or marks in the part as the part is being stamped at the various stamping stations when progressing through the die line 10. Accordingly, the marker 120 produces the circular mark diagrammatically shown at 170 in FIG. 4*a*. Marker 122 produces the increased diameter circular mark 172 of FIG. 4*b*. Marker 124 produces the still larger circular mark 174 of FIG. 4*c*. Marker 126 produces the even larger diameter circular mark 176 of FIG. 4*d* and the marker 128 produces the mark 178 which is the largest diameter mark as shown by FIG. 4*e*.

Figure 5A:
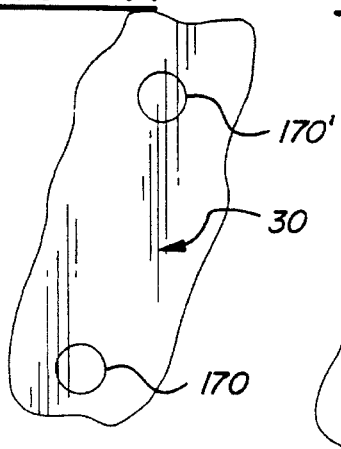
Figure 5B:
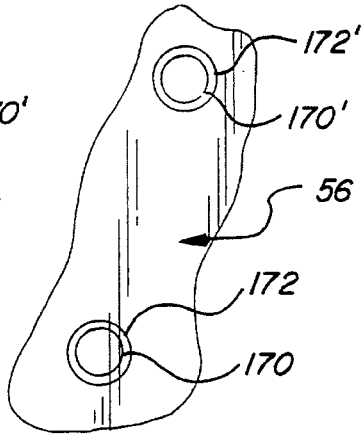
Figure 5C:
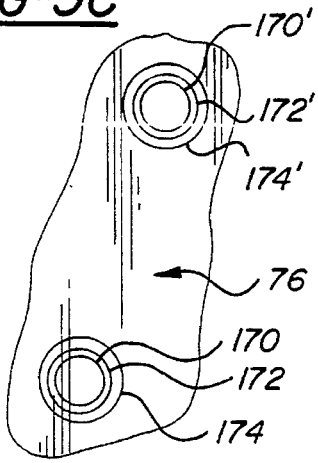

Since the marking dies 120, 122, 124, 126 and 128 are all aimed at the same target point, point T, on the part as it is being progressively stamped while being moved down the stamping line 10, the marks will accumulate into concentric form assuming that there is good gaging and alignment of the upper and lower dies of each die set. The markings, accordingly, are serially applied and accumulate into a "bulls eye" configuration 180, such as shown in FIG. 5*e*.

With such a configuration, a line operator or other observer standing at the conveyor 110 at the end of the line 10 can quickly observe the impressed and distinct circular marking to determine by the "bulls eye" configuration if all the stations are stamping to specifications.

Assuming that the fourth station guide pins are worn or broken, the fourth station marking die 126 will be off its target T of the part secured in the bottom die by the gaging blocks. If the part being stamped is moving around in the die set because of broken or worn gaging blocks or because of inaccurate gaging, the marking die will not hit the target. Accordingly, as shown in FIG. 6, the fourth ring, or mark 176 of the marking die 126 of the fourth station will not be on target and may be eccentric with target point T. since the circular mark 176 will be offset from the other circular markings and possibly overlap these markings, such as shown in FIG. 6. Accordingly, an observer in viewing the die markings on a part which are like those of FIG. 6 will notice the failure of the line 10 to stamp the part properly and will be informed by the eccentric circle 176 that the fourth station is inaccurate and requires shut down and repair.

In the preferred embodiment, first and second sets of marker dies are used in the die sets of the multi-station stamping line 10.

As best shown in FIG. 1, the marker dies 120, 122, 124, 126 and 128 of the first set are located at corresponding first specific points in the upper dies of the die sets of the stamping stations The cooperating marker dies 120', 122', 124', 126' and 128' of the second set of marker dies are located at second specific points in the upper dies of the die sets of the stamping stations.

If the dies of the die sets are appropriately aligned, and if the gaging in the die sets is correct, the markings produced on the part as it being stamped by the first and second marker die sets are diagrammatically shown in FIGS. 5*a* through 5*d*. Since there are pairs of markings at each station, the concentricity of the markings assures that there has been no appreciable turning of the part in the die set as the part is being stamped and particularly about the center of either one of the matched "bulls-eyes 180 and 180'" of FIG. 5*e*. In the event of any turning movement about one of the centers of the "bulls-eye", the ring of the other of the "bulls-eye" of the associated stamping station in which the parts are turning would be readily identifiable by the eccentric marking, such illustrated in FIG. 6. Accordingly, the pairs of markings practically eliminates any false readings.

Additionally, by observing or in some instances measuring the depth of the rings, press loads can be confirmed. If, for example, the press load is too low, the ring or other mark will be shallow indicating need for press load correction.

While a preferred method and embodiment of the invention has been shown and described, other methods and embodiments will now become apparent to those skilled in the art. Accordingly, this invention is not to be limited to that which is shown and described but by the following claims.

What is claimed is:

1. A method of stamping parts through multiple stamping stations comprising the steps of:

(a) stamping a blank at a first station into a first form while simultaneously applying a first observable mark of predetermined shape at a first place on said first form;

(b) stamping said first form at a second station into a second form while simultaneously applying a second observable mark of predetermined shape at a second place on said second form spaced from said first mark;

(c) stamping said second form into a third form at a third station while simultaneously applying a third observable mark of predetermined shape at a third place on said third form spaced from said first and second marks;

(e) comparing said first, second and third marks and to determine whether that said third form has been properly stamped at said first, second and third stations by the relationship of said first, second and third marks.

2. The method of claim 1, and further including the step of installing a separate marker die in each of said stamping stations for physically applying said marks onto said forms.

3. The method of claim 2, wherein said first, second and third marker dies have circular markers so as to impose visual circular marks on said forms at said first, second and third stations.

4. The method of claim 3, wherein said first, second and third marks indicate a properly stamped third form when substantially concentric and indicate an improperly stamped third form when said circular marks range are eccentric.

5. The method of claim 3, wherein said first, second and third marks describe concentric circles if the third form is accurately stamped at said first, second and third stations.

6. A method of stamping parts through multiple stamping stations comprising the steps of:

(a) at a first station stamping a blank into a first form while simultaneously applying a first pair of spaced observable marks of predetermined shape at a first pair of spaced places on said first form;

(b) at a second station stamping said first form into a second form while simultaneously applying a second pair of spaced observable marks of predetermined shape at a second pair of spaced places on said second form spaced from said first pair of marks;

(c) stamping said second form into a third form while simultaneously applying a third pair of observable marks of predetermined shape at a pair of spaced third places on said third form spaced from said first and second pair of marks;

(e) comparing said first, second and third pairs of marks to determine if said third form has been properly stamped at said first, second and third stations by the relationship of said first, second and third pairs of marks.

7. The method of claim 6, and further including the step of installing separate marker die for each of said pairs of markers in each of said stamping stations with each said separate marker die having a marker sized differently from the marker of the other marker dies.

8. The method of claim 7, wherein said first, second and third markers are circular so as to impose circular marks at said first, second and third stations.

9. The method of claim 8, wherein said first, second and third pairs of marks indicate a properly stamped third form when substantially concentric and indicate an improperly stamped third form when said circular marks range from an approach to overlap through full overlap.

10. The method of claim 8, wherein said first, second and third pairs of marks describe substantially concentric circles if the third form is accurately stamped at said first, second and third stations.

* * * * *